US010287050B2

(12) United States Patent
Roe

(10) Patent No.: US 10,287,050 B2
(45) Date of Patent: May 14, 2019

(54) IN-LINE LABEL APPLICATOR

(71) Applicant: ID TECHNOLOGY LLC, Fort Worth, TX (US)

(72) Inventor: John A. Roe, Hewitt, NJ (US)

(73) Assignee: ID TECHNOLOGY LLC, Fort Worth, TX (US)

( * ) Notice: Subject to any disclaimer, the term of this patent is extended or adjusted under 35 U.S.C. 154(b) by 162 days.

(21) Appl. No.: 15/363,215

(22) Filed: Nov. 29, 2016

(65) Prior Publication Data

US 2017/0152070 A1 Jun. 1, 2017

Related U.S. Application Data

(60) Provisional application No. 62/261,600, filed on Dec. 1, 2015.

(51) Int. Cl.

| | |
|---|---|
| ***B65C 9/08*** | (2006.01) |
| ***B41J 2/01*** | (2006.01) |
| ***B65C 3/16*** | (2006.01) |
| ***B65C 9/04*** | (2006.01) |
| ***B65C 9/18*** | (2006.01) |
| ***B65C 9/46*** | (2006.01) |
| *B65C 9/40* | (2006.01) |

(52) U.S. Cl.

CPC ..... *B65C 9/08* (2013.01); *B65C 3/16* (2013.01); *B65C 9/04* (2013.01); *B65C 9/1869* (2013.01); *B65C 9/46* (2013.01); *B65C 2009/404* (2013.01)

(58) Field of Classification Search

CPC .... B65C 3/16; B65C 9/04; B65C 9/08; B65C 9/1869; B65C 9/40; B65C 9/46; B65C 2009/404; B65C 2009/407; B41J 2/01

See application file for complete search history.

(56) References Cited

U.S. PATENT DOCUMENTS

| | | | |
|---|---|---|---|
| 3,536,550 | A | 10/1970 | von Hofe |
| 4,029,537 | A | 6/1977 | Kish |
| 4,080,239 | A | 3/1978 | Real et al. |
| 4,242,167 | A | 12/1980 | Hoffmann |
| 4,261,788 | A | 4/1981 | McClung |
| 4,390,390 | A | 6/1983 | Margraf et al. |
| 4,558,653 | A | 12/1985 | Horton et al. |
| 4,619,726 | A | 10/1986 | Cook et al. |
| 4,944,827 | A | 7/1990 | Lilly et al. |
| 5,587,043 | A | 12/1996 | Hying et al. |

(Continued)

FOREIGN PATENT DOCUMENTS

WO WO 2012/048324 4/2012

OTHER PUBLICATIONS

PCT, International Search Report and Written Opinion, International Application No. PCT/US2016/063928; dated Feb. 2, 2017, 8 pages.

*Primary Examiner* — George R Koch
(74) *Attorney, Agent, or Firm* — Thompson Hine L.L.P.

(57) ABSTRACT

An in-line label applicator includes a label printer to print variable data on each label and a label application station that moves the printed labels into a container conveyance path for application to containers moving along the path. One scanner scans the label code of each printed label before the label reaches the conveyance path, and another scanner scans the helper code of each container as the label is being applied during movement of the container along the conveyance path.

19 Claims, 5 Drawing Sheets

(56) References Cited

U.S. PATENT DOCUMENTS

| | | | | |
|---|---|---|---|---|
| 6,378,588 | B1 | 4/2002 | Nixon et al. | |
| 6,511,569 | B1 | 1/2003 | Nixon et al. | |
| 6,768,502 | B2 | 7/2004 | Milton | |
| 7,469,736 | B2 | 12/2008 | Fries et al. | |
| 7,757,739 | B2 | 7/2010 | Fries et al. | |
| 8,033,312 | B2 | 10/2011 | Fries et al. | |
| 8,186,408 | B2 | 5/2012 | Fries et al. | |
| 8,756,124 | B1 | 6/2014 | Sayers, III et al. | |
| 8,936,841 | B2 | 1/2015 | Katarya et al. | |
| 9,008,815 | B2 | 4/2015 | Popp | |
| 9,195,228 | B2 | 11/2015 | Popp | |
| 9,483,496 | B1 | 11/2016 | Washburne et al. | |
| 2002/0096261 | A1* | 7/2002 | Yang | B65C 9/44 156/352 |
| 2006/0277269 | A1* | 12/2006 | Dent | G06Q 50/24 709/217 |

* cited by examiner

IN-LINE LABEL APPLICATOR

TECHNICAL FIELD

This application relates generally to in-line label applicators for applying printed labels to containers and, more specifically, to an in-line label applicator that applies printed labels to containers moving along a conveyance path while at the same time identifying container helper codes and associating the container helper codes to label codes that are printed on the labels applied to the containers.

BACKGROUND

Government mandates to serialize pharmaceutical products are increasing around the globe. The Drug Supply Chain Security Act, enacted in November 2013, requires that manufacturers begin serializing all drug products at the saleable unit and case level for the U.S. market starting in November 2017. The EU, China and Brazil have all enacted similar mandates.

There are two predominant drivers behind these serialization mandates: (1) fighting grey market diversion and counterfeiting and (2) aid in government reimbursement programs. Details vary from region to region, but in general all mandates require marking the smallest unit of sale with lot and expiration information, as well as a serial number, creating a unique license plate for each unit. Typically, as suggested in FIG. 1, to facilitate tracking units through the supply chain, units 10 are aggregated into bundles 12, bundles 12 into cases 14 and cases 14 onto pallets 16, with the parent child relationships maintained in a database. "License plate" information for units, bundles, cases and pallets is typically marked on the product in human readable form, as well as being encoded in a 2D code and/or an RFID tag.

The lion's share of the effort required to implement Track & Trace is spent on data management. Tracking the chain of custody of each unit from manufacturing, through distribution, up to the point where it is administered is a monumental task. The data security to ensure that each unit can be authenticated adds to the complexity.

The first critical piece of the chain occurs right on the packaging line. Precise and consistent product handling, marking, inspection and data gathering are required to introduce accurate data into the front end of the system, where individual units (e.g., bottles or other containers) are labeled. In non-RFID systems, variable information printed on each label may include human readable Lot Number, Expiry Date, Serial Number and GTIN along with a 2D code (Label Code) representing the human readable data, along with other information. The GTIN is a code which is used to identify the product. The Serial number combined with the GTIN, uniquely identifies each bottle, throughout the supply chain, all the way to the end user. A label is typically applied to each bottle using a bottle wrap labeler, which wraps the label around the circumference of the product. Once the label is applied to the product, the Label Code can be located anywhere around the circumference of the bottle, making it difficult to scan.

On a typical serialization line, labeled bottles are transported on a conveyor and those bottles need to be identifiable at one or more points along the conveyor. As a bottle moves along the conveyor, it rotates, making it impractical to locate and read the Label Code with a single scanner. An array of scanners, typically four or six, located at angles to the conveyor (Scan Tunnel), can be used to scan images of the label from multiple angles. A sophisticated "stitching" algorithm can be used to piece the images together into a single image, which approximates the flat label. A second algorithm scans the stitched image to locate and read the 2D code.

To eliminate the need for a Scan Tunnel at every point along the line, where the bottle needs to be identified, a separate 2D code (Helper Code) is printed on either the top or the bottom surface of the bottle. The Helper Code is a serial number, assigned to each bottle, to uniquely identify the bottle during the packaging and aggregation process. Because the Helper Code is printed on a nominally flat surface, it can be easily read by a single scanner. The Label Code and the Helper Code need to be associated in a database, allowing access to the unique fixed and variable information printed on the label, by simply scanning the more easily read Helper Code.

In the past, the most commonly used existing technique for associating the Label Code to the Helper Code is to utilize a scan tunnel at a location downstream of the location where the label has been applied to the container. As this downstream station, the containers are passed through a scan tunnel to acquire the Label Code and the Label Code is entered into a FIFO device. A short distance downstream the Helper Code is then scanned and associated with the oldest Label Code in the FIFO device.

It would be desirable to provide a system and method that eliminates the need for a downstream scan tunnel and the associated capital cost, maintenance cost and points of failure.

SUMMARY

In one aspect, an in-line label application system for applying printed labels to round container products includes a conveyance path along which round container products are moved in an upright orientation, each round container product having a respective unique helper code on a bottom side. A wrap label application arrangement applies wrap labels circumferentially onto the round container products and include a label printing device, a label scanner, a label application station and a helper code scanning device. The label printing device prints a label code onto each label passing thereby. The label scanner reads the label code on each label after printing and before application of the label to a round container product. At the label application station each label is moved into the conveyance path and applied to a respective round container product as the product is rotated. The helper code scanning device is positioned to scan the helper code of each round container product as a printed label is applied to the round container product, where the helper code scanning device located below the conveyance path.

In another aspect, an in-line label applicator includes a label printer to print variable data on each label and a label application station that moves the printed labels into a container conveyance path for application to containers moving along the path. One scanner scans the label code of each printed label before the label reaches the conveyance path, and another scanner scans the helper code of each container as the label is being applied during movement of the container along the conveyance path.

In another aspect, an in-line label application system for applying printed labels to round container products includes a conveyance path along which round container products are moved in an upright orientation. A wrap label application arrangement applies wrap labels circumferentially onto the round container products, the arrangement including a label printing device, a label scanner, a label application station and a container scanner. The label printing device prints a unique label code onto each label passing thereby. The label scanner reads the label code on each printed label after printing and before application of the label. At the label application station each printed label is moved into the conveyance path and applied to a respective round container product as the round container product is rotated. The container scanner is positioned to read a helper code of each round container product at the label application station. A control system coordinates operation of the label printing device, the label scanner and the container scanner. The control system is configured to: receive label code data for each printed label from the label scanner and sequentially load the label code data into one of a shift register, a FIFO device or other logical mechanism; and during application of a given printed label to a given round container product at the label application station, output the label code data associated with the given printed label from the shift register, FIFO or other logical mechanism to a database in coordination with output of helper code data for the given round container product from the container scanner to the database such that the label code data of the given printed label is associated with the helper code data of the given round container product.

In another aspect, a method for applying labels to containers involves: a—conveying containers along a conveyance path; b—setting a defined container spacing as containers enter a label application station; c—utilizing a label applicator to dispense a given label from a backing web and to move the label into the conveyance path to apply the label to a given container, where the given container includes a helper code thereon and the given label includes a label code thereon; d—utilizing a first scanner located along a label stock feed path to capture the label code of the given label prior to the given label being moved into the conveyance path; e—utilizing a second scanner located at the label application station to capture the helper code of the given container as the given label is being applied to the given container; and f—linking the scanned label code with the scanned helper code.

The details of one or more embodiments are set forth in the accompanying drawings and the description below. Other features, objects, and advantages will be apparent from the description and drawings, and from the claims.

DETAILED DESCRIPTION

Figure 1:
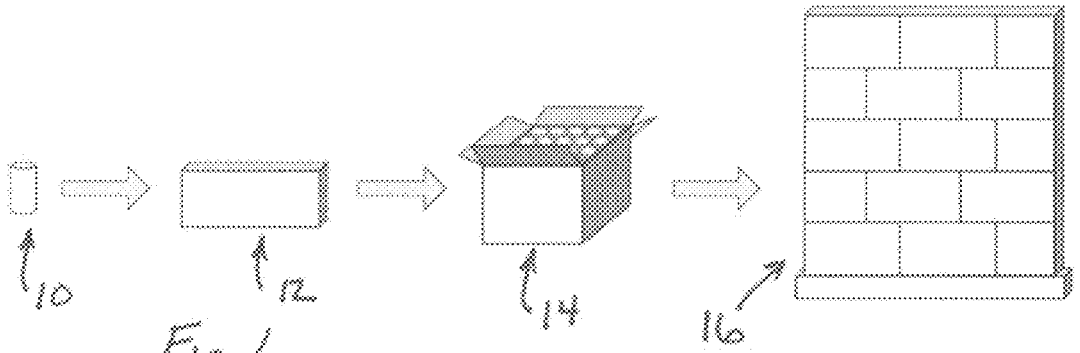
FIG. 1 shows a serialization flow for units, bundles, cases and pallets.
Figure 2:
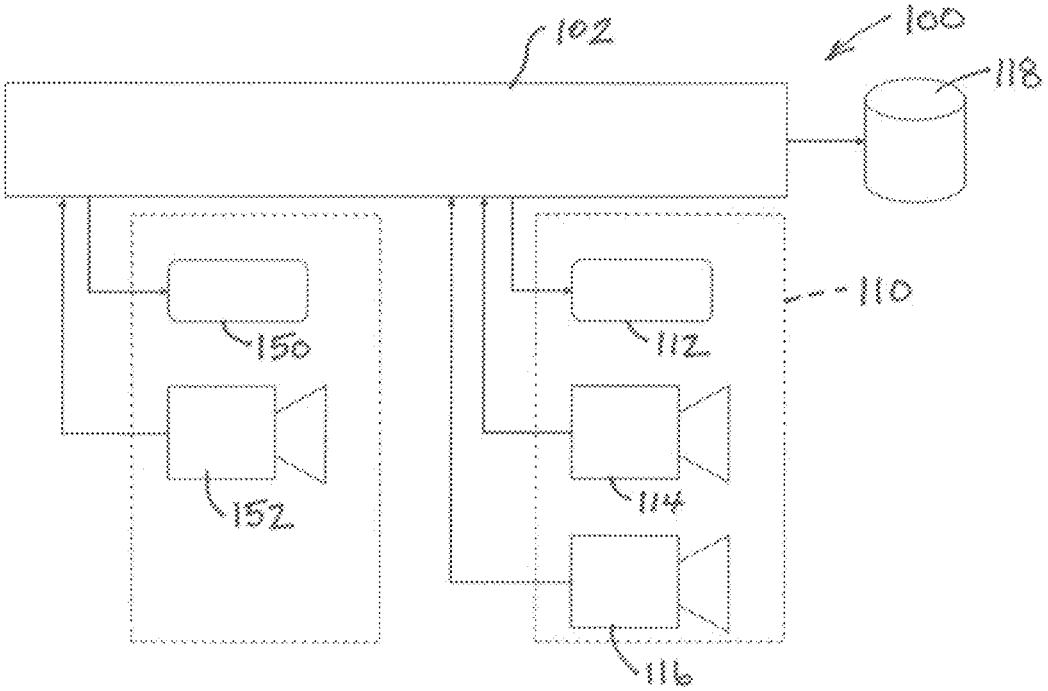
FIG. 2 shows a high-level diagram of an in-line label application system.
Figure 3:
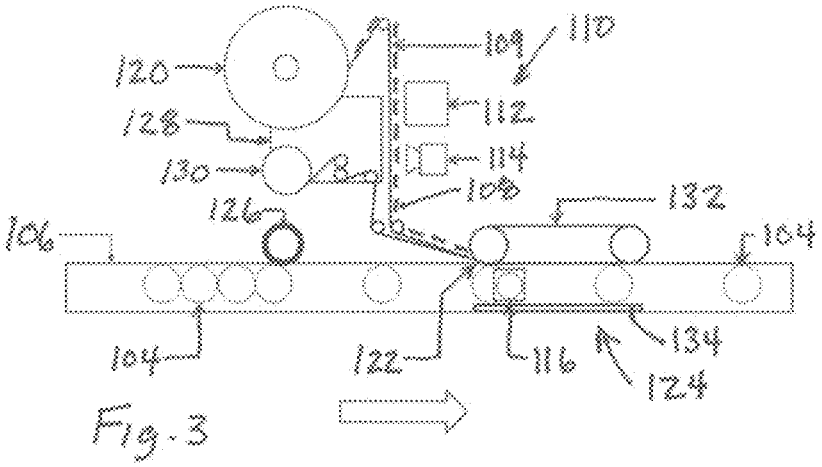
FIG. 3 shows a schematic top plan view of an -inline label applying system.
Figure 4:
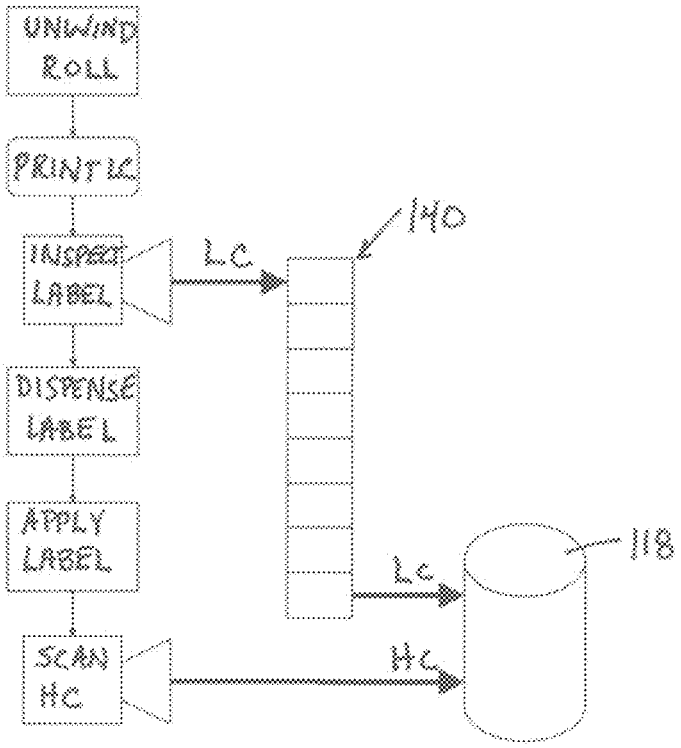
FIG. 4 depicts a flow process for serialization.
Figure 5:
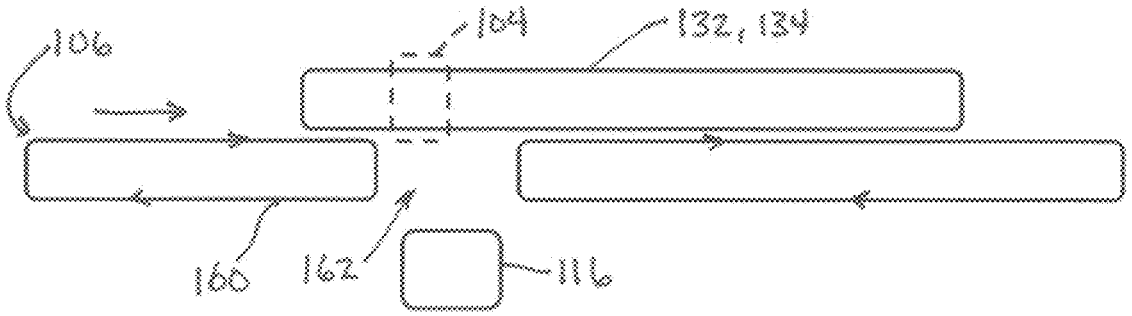
FIG. 5 shows a schematic side elevation of the system of FIG. 3 where the helper code scanner is below the conveyance path.

Referring to FIGS. 2-5, an in-line label application system 100 includes one or more computers and/or programmable logic controllers (PLCs) making up a control system 102 that coordinates the physical movement of products 104 along a conveyance path 106 and the printing and movement of labels 108 on a web 109 through a wrap labeler 110. The control system 102 generates the Helper Codes to be printed on the products (e.g., by a printer 150 (FIG. 2, but not shown in FIG. 3) upstream of the label application station). The control system 102 also generates the Label Codes to be printed on the labels by label printer 112, transmitting the data to the printers 150, 112 at the appropriate times. The control system 102 also takes input from the label inspection scanner 114 and the helper code scanner 116, and creates the association between the Label Code and the Helper Code for each product and stores the associated codes in a database 118. The products may be round containers (e.g., containers having a sidewall or sidewall portion of substantially round cylindrical shape).

The label web 109 with labels is delivered along a label stock feed path from a label supply roll 120 past the label printer 112, past the label scanner 114 and toward the conveyance path 106 to a merge point 122 of a label application station 124 where the labels are pealed from the web and moved into the conveyance path to be applied to containers.

In most cases, Helper Codes are printed on either the top surface or the bottom surface of each product, upstream from the bottle wrap labeler 110. Helper Codes are printed using an inkjet coder, a laser coder or similar printing technology 150. UV inkjet, which is invisible to the human eye, may be used in applications where concealing the helper code from the end user is preferred. A container scanner 152 directly downstream from the helper code printer 150, inspects the printed code. A reject device (not shown) removes products with invalid or poor quality codes prior to entering the labeler 110. In an alternate configuration, the spacing device (mentioned below) at the infeed to the labeler 110 can be designed to accommodate Helper Code printing and inspection process. In another alternative, the Helper Code may be printed on the product at the label application station.

For clarity, the bottle wrap labeler 110 can be considered as a collection of subsystems, namely product handling, labeling head and wrap applicator. In the simplest configuration, the product handling subsystem is comprised of a conveyor arrangement that makes up the portion of the conveyance path 106 through the labeler 110 to transport products and a spacing device 126 to create an appropriate, desired space between products 104 for label application.

The labeling head 128 unwinds the web of labels from the label roll 120, separates each label 108 from the web 109 for application to a product 104 (e.g., via a sharp turn around a peel bar at merge point 122) and rewinds the remaining web liner 109 onto a rewind roll 130. The labeling head 128 performs additional functions prior to separating the label from the liner for the purpose of serialization, including printing variable data on each label 108 via label printer 112 and inspecting the fixed and/or variable data on each label 108 using the label inspection scanner 114.

A wrap applicator at the label application station 124 rotates each product (e.g., by using a moving wrap belt 132 and spaced apart plate or wall 134 on opposite lateral sides of the conveyance path) to wrap a label 108 around the circumference of the product 104 as the label is dispensed from the labeling head at the application or merge point 122. As products 104 pass the application point 122, the labeling head 128 advances the label web 109 in an intermittent fashion, one label 108 for each product 104 that passes.

After being unwound from the supply roll 120, the web of labels passes the label printer 112, where variable information (including the Label Code (LC in FIG. 4) is printed on each label 108. Label information may, by way of example, be printed using thermal transfer, laser or inkjet technologies. The label inspection scanner 114, immediately downstream from the label printer 112, reads the printed information, including the Label Code, and transmits the data to the Control System 102, which verifies that the print quality is satisfactory and that the printed information on the label is correct.

After scanning by the label code scanner 114, the Label Code LC is entered into a shift register 140 or other logical mechanism. As the web advances, the Label Code is tracked in the shift register. When a product 104 reaches the application point 122, it is captured between the wrap belt 132 and a fixed high friction back-up plate 134. This causes the product 104 to rotate as it continues down the conveyance path 106. The labeling head 128 dispenses the label 108 into the pinch point between the product 104 and the wrap belt 132. The surface speed of the wrap belt and the labeling head dispense speed are synchronized such that the label is wrapped around the circumference of the product as it is dispensed from the labeling head 128.

While the label 106 is being wrapped around the product, a scanner 116 reads the Helper Code HC. The control system 102 associates the Label Code LC for the label being dispensed with the Helper Code HC scanned at the dispense point (e.g., by outputting the proper label code LC from the shift register to the database at the same time as the helper code HC is scanned and sent to the database) and records the association in a database. For this purpose, the stack size of the shift register is generally sized to correspond to the number of labels on the portion of the web liner between the label printer 112 and the label application point 122. For a given web distance between those two locations, the stack size will generally be larger for smaller length labels as compared to larger length labels (assuming equal spacing between labels as between the different label sizes).

As mentioned above, the Helper Code can be printed on either the top surface or the bottom surface of the product. When the helper code is printed on top of the product—14, the Helper Code scanner 116 may be mounted on an adjustable bracket, located over the wrap belt 132, such that the Helper Code is scanned as the label is applied to the product. As suggested in FIG. 5, if the Helper Code is printed on the bottom of the product 104, the under product conveyor 160 may be split to create a gap 162 at the label application point such that the product 104 is supported between the wrap belt 132 and the back-up plate 134 during label application, while the container scanner 116 positioned below the conveyance path (e.g., mounted on an adjustable bracket) to scan the Helper Code as the label is applied to the product 104.

The word scanner is used throughout the discussion above. In most applications, both the Label Code and the Helper Code are 2D codes. Image capture type scanners or machine vision cameras may be used for this scanner functionality. In addition to reading the codes, these cameras may provide other functionality such as print quality inspection for the human readable variable data as well as the 2D codes. Additional cameras or other sensors, located along the conveyor can be used to inspect products to ensure that a label has been properly applied to each product.

In most applications, the control system 102 includes a PLC to control the physical functionality of the labeler, along with a Management Execution System (MES), having of one or more computers to manage the data sent to the printers, the data received from the cameras and the database that associates Label Codes with Helper Codes. The MES provides additional functionality including aggregation of products to bundles, bundles to cases and cases to pallets. Most MES implementations also provide rework capability to allow for dis-aggregation and re-aggregation for quality assurance and other purposes.

The above-described in-line label application system advantageously eliminates the need for a scan tunnel downstream of the label application station, reducing equipment cost and reducing overall line footprint.

The labeler control system 102 may also include functionality for tracking products through the system and rejecting products that fail inspection at any of the inspection points. Reject verification sensors and logic ensures that only products that pass all inspections are delivered to the next downstream process. For example, if a printed label 108 does not pass the label code inspection via scanner 114 a record of the failure is made. The defective label will still be applied to a product 104 and associated with a helper code in the database, along with a reject indicator. Downstream of the label application the product with the defective label can be rejected out of the processing path by scanning the associated helper code to identify which products have associated reject indicators and should be rejected.

Figure 6:
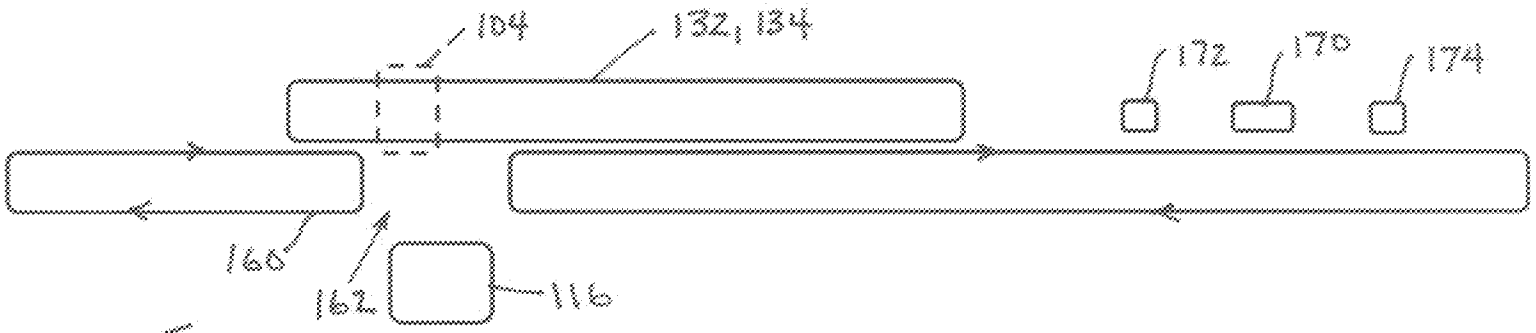
FIG. 6 shows a schematic side elevation of a system that includes a container reject device.

Alternatively, the in-line label applicator itself can incorporate the reject functionality without requiring additional helper code scanning. In particular, and referring to FIG. 6, another embodiment is shown in which a reject device 170 (e.g., in the form of a container push device or in the form of a container blow-off device) is located downstream of label application. A product detector 172 is located upstream of the reject device and a product detector 174 is located downstream of the reject device. The control system 102 is configured to selectively operate the reject device 170 when the label code on a particular printed label as read by the label scanner 114 is determined to be defective and the particular container product on which the particular printed label is applied reaches the reject device 170. For this purpose, the control system 102 may operates such that, upon determining that the label code for the particular printed label is defective, the control system tracks a count of labeled container products that reach the reject device (e.g., by using pass/fail data loaded into a shift register for each printed label) in order to selectively trigger the reject device. Reject operations may also be effected by the product detector 172 if, for example, the product detector indicates that a label has not been applied to a round container product (e.g., the control system can load fail data into the shift register based upon the indication from the detector 172, which may determine the presence or absence of a label based upon UV reflectivity). The downstream detector 174 may be used by the control system 102 to verify that a container has in fact been rejected and moved of the conveyance path by the reject device as desired.

Figure 7:
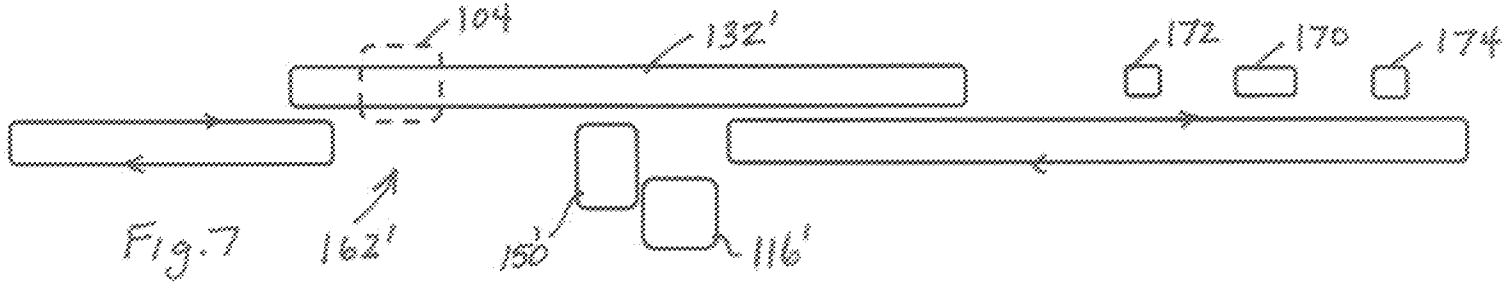
FIGS. 7 and 8 show schematic side elevation and top plan views of another embodiment of an in-line label application system in which helper code printing is incorporated into the label applying station.
Figure 8:
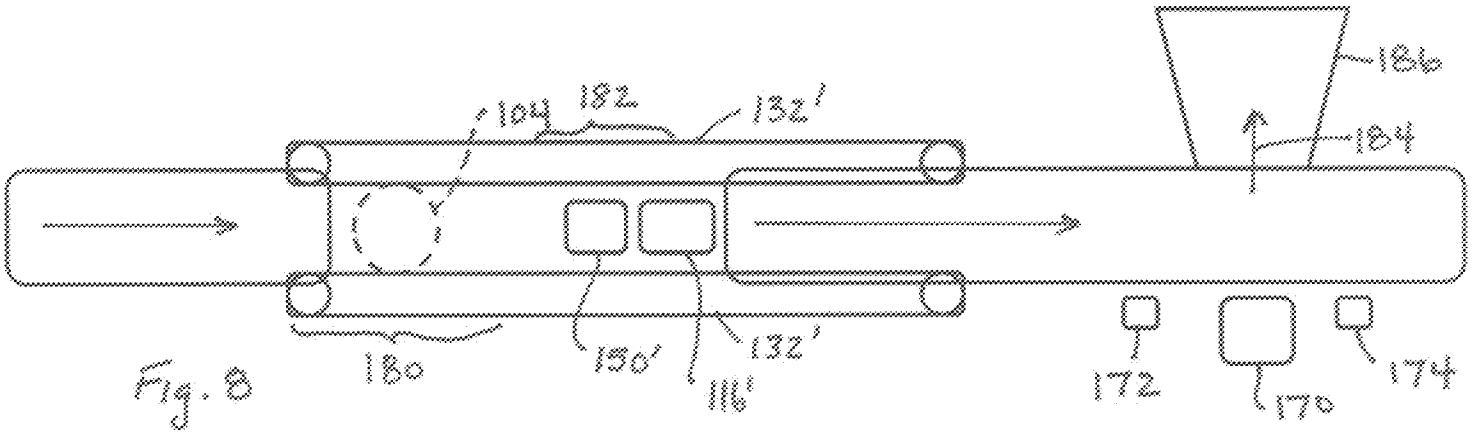

While the above described variants contemplate Helper Code printing upstream of the label application station, it is recognized that the Helper Code could in fact be printed at the label application station as well. In this regard, reference is made to FIGS. 7 and 8 where the underside conveyor gap 162' is larger and both the container printer 150' and the container scanner 116' are located in the gap 162'. Here, the lateral conveyance arrangement to support the products 104 takes the form of a pair of spaced apart wrap belts 132' such that the products are engaged by both belts. When a product 104 is in an upstream zone 180 of the wrap belts 132', the control system controls the belts 132' so that the product 104 is rotated to apply the label (e.g., by moving the belts at different speeds and/or in different directions). When the product 104 reaches a downstream zone 182 of the wrap belts 132' the control system controls the belts 132' so that the container is not rotated as it moves over the printer 150'. This arrangement eliminates the need for the upstream helper code scanner 152 by incorporating its purpose and function into scanner 116'. The reject device 170 and detectors 172, 174 are also shown, along with the reject path 184 out of the conveyance path (e.g., into a collection bin or station 186).

It is to be clearly understood that the above description is intended by way of illustration and example only, is not intended to be taken by way of limitation, and that other changes and modifications are possible.

What is claimed is:

1. An in-line label application system for applying printed labels to round container products, the system comprising:

a conveyance path along which round container products are moved in an upright orientation, each round container product having a respective unique helper code on a bottom side, wherein each respective unique helper code is different in order to uniquely identify each respective round container product;

a wrap label application arrangement for applying wrap labels circumferentially onto the round container products, the arrangement including:

a label printing device for printing a unique label code onto each label passing thereby;

a label scanner for reading the unique label code on each label after printing and before application of the label to a round container product;

a label application station at which each label is moved into the conveyance path and applied to a respective round container product as the product is rotated;

a helper code scanning device positioned to scan the unique helper code of each round container product as a printed label is applied to the round container product, the helper code scanning device located below the conveyance path;

a control system for coordinating operation of the label printing device, the label scanner and the helper code scanning device, the control system configured to receive unique label code data from the label scanner for each label and to associate the unique label code data with unique helper code data of the round container product to which the label is applied such that, for each round container product that is labeled, the unique label code data of the label applied to the round container product is associated with the unique helper code data of the round container product without scanning of the unique label code after the label is applied to the round container product.

2. The system of claim 1 wherein the conveyance path includes a gap in an under container conveyor arrangement above a location of the container scanner to enable unique helper codes to be scanned.

3. The system of claim 1 wherein each round container product is vertically supported by a lateral conveyance arrangement that comprises at least one lateral wrap belt when moving over the gaps and the helper code scanning device to enable unique helper codes to be scanned.

4. The system of claim 1 wherein the control system is configured to sequentially load the unique label code data of each printed label into one of a shift register, a FIFO device or other logical mechanism, and during application of a given printed label to a given round container product, to output the unique label code data associated with the given printed label to a database in coordination with output of unique helper code data for the given round container product by the helper code scanning device to the database, such that the unique label code data of the given printed label is linked with the unique helper code data of the given round container product.

5. An in-line label application system for applying printed labels to round container products, the system comprising:

a conveyance path along which round container products are moved in an upright orientation;

a wrap label application arrangement for applying wrap labels circumferentially onto the round container products, the arrangement including:

a label printing device for printing a unique label code onto each label passing thereby;

a label scanner for reading the unique label code on each printed label after printing and before application of the label;

a label application station at which each printed label is moved into the conveyance path and applied to a respective round container product as the round container product is rotated;

a container scanner positioned to read a unique helper code of each round container product at the label application station, wherein each round container product has a different unique helper code in order to uniquely identify each round container product;

a control system for coordinating operation of the label printing device, the label scanner and the container scanner, wherein the control system is configured to:

receive unique label code data for each printed label from the label scanner and sequentially load the label code data into one of a shift register, a FIFO device or other logical mechanism; and during application of a given printed label to a given round container product at the label application station, output the unique label code data associated with the given printed label from the shift register, FIFO or other logical mechanism to a database in coordination with output of unique helper code data for the given round container product from the container scanner to the database such that the unique label code data of the given printed label is associated with the unique helper code data of the given round container product without scanning of the unique label code after the given printed label is applied to the given round container product.

6. The system of claim 5 wherein:

a number of instances of unique label code data stored in the shift register, the FIFO device or other logical mechanism corresponds directly to a number of labels on a label web that are located between the label scanner and the label application station.

7. The system of claim 5 wherein:

the wrap label application arrangement includes a reject device located at an output end of the label application station for selectively moving labeled round container products out of the conveyance path;

the control system configured to selectively operate the reject device when the unique label code on a particular printed label as read by the label scanner is determined to be defective and a particular labeled round container product on which the particular printed label is applied reaches the reject device.

8. The system of claim 7 wherein:

the control system utilizes a shift register, FIFO or other logical mechanism to effect operation of the reject device in order to selectively trigger the reject device.

9. The system of claim 5 further comprising:

a product print device for applying a unique helper code to each container as it moves along the conveyance path.

10. The system of claim 9 wherein:

the product print device is located at the label application station downstream of a merge point of labels into the conveyance path and upstream of the container scanner.

11. The system of claim 10 wherein:

the label application station includes a pair of lateral wrap belts that engage the round container products;

for each round container product the control system is configured to (i) initially operate the pair of lateral wrap belts so as to rotate the round container product during label application and (ii) thereafter operate the pair of lateral wrap belts to prevent rotation of the round container product as the round container product moves past the product print device for printing of the unique helper code on the round container product.

12. The system of claim 5 wherein:

the conveyance path includes a gap in an under container conveyor arrangement above a location of the container scanner to enable unique helper codes to be scanned;

wherein each round container product is vertically supported for movement over the gap by a lateral conveyance arrangement that comprises at least one lateral wrap belt that operates to rotate the round container product for label application; and the container scanner reads the unique helper code of the round container product during rotation of the round container product for label application.

13. An in-line label application system for applying printed labels to round container products, the system comprising:

a conveyance path along which round container products are moved in an upright orientation, each round container product having a respective unique helper code on one of a bottom side or a top side, wherein each respective unique helper code is different in order to uniquely identify each respective round container product;

a wrap label application arrangement for applying labels circumferentially onto the round container products, the arrangement including:

a first scanner for scanning a unique label code on each label before application of the label to a round container product;

a label application station at which each label is moved into the conveyance path and applied to a respective round container product as the respective round container product is rotated, the first scanner located along a label path upstream of a point where the label path moves labels into the label application station;

a second scanner positioned to scan the unique helper code of each round container product as one of the labels is being applied to the round container product;

a control system operatively connected with the first scanner and the second scanner, wherein the control system is configured such that, for a given label that is applied to a given round container product, the control system tracks the unique label code of the given label received from the first scanner until the given label reaches the label application station and the control system then links the unique label code of the given label with the unique helper code of the given round product as scanned by the second scanner by storage of both the unique label code and unique helper code in a database without scanning of the unique label code after the given label is applied to the given round container product.

14. A method for applying labels to containers, the method comprising:

a—conveying containers along a conveyance path;

b—setting a defined container spacing as containers enter a label application station;

c—utilizing a label applicator to dispense a given label from a backing web and to move the label into the conveyance path to apply the label to a given container, where the given container includes a unique helper code thereon and the given label includes a unique label code thereon, wherein the unique helper code of the given container uniquely identifies the given container from other containers;

d—utilizing a first scanner located along a label stock feed path to capture the unique label code of the given label prior to the given label being moved into the conveyance path;

e—utilizing a second scanner located at the label application station to capture the unique helper code of the given container as the given label is being applied to the given container; and f—linking the scanned unique label code with the scanned unique helper code in a database without scanning of the unique label code after the given label is applied to the given container.

15. The method of claim 14, further comprising repeating steps a-f for multiple labels and multiple corresponding containers.

16. The method of claim 14 wherein:

a labeling control system obtains the unique label code from the given label prior to application of the given label to the given container;

the given label is applied to the given container as the given container moves along the conveyance path;

the unique helper code on the given container is scanned while the given label is being applied to the given container;

the control system stores the scanned unique label code of the given label in association with the scanned unique helper code of the given container in the database.

17. The method of claim 16 wherein the control system tracks the unique label code from the second scanner as the given label moves to the label application station using one of a shift register, a FIFO device or other logical mechanism.

18. The method of claim 17 wherein:

the unique label code is tracked in a PLC, and/or the unique label code is tracked in an MES system.

19. The method of claim 14 wherein the given container is a round container product, the label application station includes a wrap labeler that rotates the given container for label application, the unique helper code is located on a bottom surface of the given container and the second scanner is located below the conveyance path.

* * * * *